US007694832B2

(12) United States Patent
Kao

(10) Patent No.: US 7,694,832 B2
(45) Date of Patent: Apr. 13, 2010

(54) SUSPENSION DISPLAY RACK

(76) Inventor: Jui-Chien Kao, No. 358, Tunghsing Rd., Shuwan Li, Tali City, Taipei Hsien (TW)

( * ) Notice: Subject to any disclaimer, the term of this patent is extended or adjusted under 35 U.S.C. 154(b) by 0 days.

(21) Appl. No.: 12/354,848

(22) Filed: Jan. 16, 2009

(65) Prior Publication Data

US 2009/0120884 A1 May 14, 2009

Related U.S. Application Data

(63) Continuation-in-part of application No. 11/185,000, filed on Jul. 20, 2005, now abandoned.

(51) Int. Cl.
*A47F 7/00* (2006.01)

(52) U.S. Cl. ..... 211/70.6

(58) Field of Classification Search ..... 211/70.6, 211/94.01, 89.01, 60.1, 69; 206/376, 378, 206/372, 373
See application file for complete search history.

(56) References Cited

U.S. PATENT DOCUMENTS 4,678,151 A * 7/1987 Radek ..... 248/223.41
5,259,519 A * 11/1993 Lieberman ..... 211/66
5,511,675 A * 4/1996 Frederick ..... 211/193
5,743,414 A * 4/1998 Baudino ..... 211/69.1
5,855,284 A * 1/1999 Dembicks ..... 211/70.6
5,918,842 A * 7/1999 Garfinkle ..... 248/223.41
6,431,373 B1 * 8/2002 Blick ..... 211/70.6
6,626,402 B1 * 9/2003 Kaminstein ..... 248/110
7,258,239 B2 * 8/2007 Kao ..... 211/70.6
7,523,832 B2 * 4/2009 Kao ..... 211/70.6
2007/0017886 A1 * 1/2007 Kao ..... 211/94.01
2008/0041800 A1 * 2/2008 Kao ..... 211/70.6
2009/0120885 A1 * 5/2009 Kao ..... 211/70.6
2009/0194494 A1 * 8/2009 Kao ..... 211/70.6

* cited by examiner

*Primary Examiner*—Jennifer E. Novosad
(74) *Attorney, Agent, or Firm*—Bacon & Thomas, PLLC

(57) ABSTRACT

A suspension display rack for hand tools has a rail and multiple sliding blocks. The rail has a back-strip and two hooks. The hooks are formed on the back strip and each hook has a longitudinal groove. Each sliding block has a base, two cylindrical slides and a seat. The cylindrical slides are respectively received in the grooves so that the hand tools can be hung on the sliding blocks to transversely slide along the rail.

1 Claim, 14 Drawing Sheets

SUSPENSION DISPLAY RACK

The present invention is a continuation-in-part (CIP) application claiming the benefit of U.S. patent application Ser. No. 11/185,000 filed on Jul. 20, 2005.

BACKGROUND OF THE INVENTION

1. Field of the Invention

The present invention relates to a suspension display rack for hand tools, and more particularly to a suspension display rack on which the hand tools can be arranged with a freely arranged distance between the tools.

2. Description of Related Art

A conventional tool display rack comprises a base, multiple seats respectively mounted on the base to abut or grip blades of screwdrivers, and a board mounted on the base to press against handles of the screwdrivers. Each seat has an abutting means and a handling means thereby cooperating with the board to securely fasten the screwdrivers to the rack.

However, with the fixed distance of the adjacent seats, each seat only retain one kind of the screwdriver such that the conventional suspension rack can not hang screwdrivers with different specifications. Furthermore, the seats are securely mounted on the base and can not be separated from the base such that the quantity of the seats can not be changed and therefore, the conventional suspension display rack is not versatile.

Furthermore, U.S. Pat. No. 4,597,496 discloses a tool holder having two opposite mounting channels and two fingers arrays. The finger arrays have multiple resilient fingers to hold tools. However, the brush-like fingers are not rigid enough to hold heavy tools. Furthermore, both the two mounting channels are needed to hold the finger arrays therebetween, which makes the tool holder structurally complicated and incompact and has high material and manufacturing costs.

U.S. Pat. No. 6,564,949 discloses a holder for a power operated screwdriver and has two retaining jaws. The retaining jaws for holding heavy pneumatic screwdriver are block-like instead of being plate-like, which has high material costs.

U.S. Pat. No. 4,467,925 discloses a tool storage rack having multiple sleeves. Each sleeve has two spaced hooking projections for hooking tools. However, each hooking projection cannot work without the other hooking projection.

U.S. Pat. No. 6,450,338 discloses a socket retainer having a main body and a flexible buckling portion protruding forwards from the main body. A socket may be mounted around the flexible buckling portion. However, the flexible buckling portion protruding laterally instead of protruding uprightly so that the socket easily falls off. Furthermore, the socket is mounted laterally on the socket retainer with an axis lying horizontally so that an identification label on an outer surface of the socket indicating a dimension such as the diameter would not be seen easily.

Therefore, the invention provides a suspension display rack for hand tools to mitigate or obviate the aforementioned problems.

SUMMARY OF THE INVENTION

The main objective of the present invention is to provide a suspension display rack for hand tools, on which the hand tools can be arranged and hung with free distances among the tools.

A suspension display rack for hand tools in accordance with the present invention has a rail and multiple sliding blocks. The rail has a back-strip and two hooks. The hooks are formed on the back strip and each hook has a longitudinal groove. Each sliding block has a base, two cylindrical slides and a seat. The cylindrical slides are respectively received in the grooves so that the hand tools can be hung on the sliding blocks to transversely slide along the rail.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
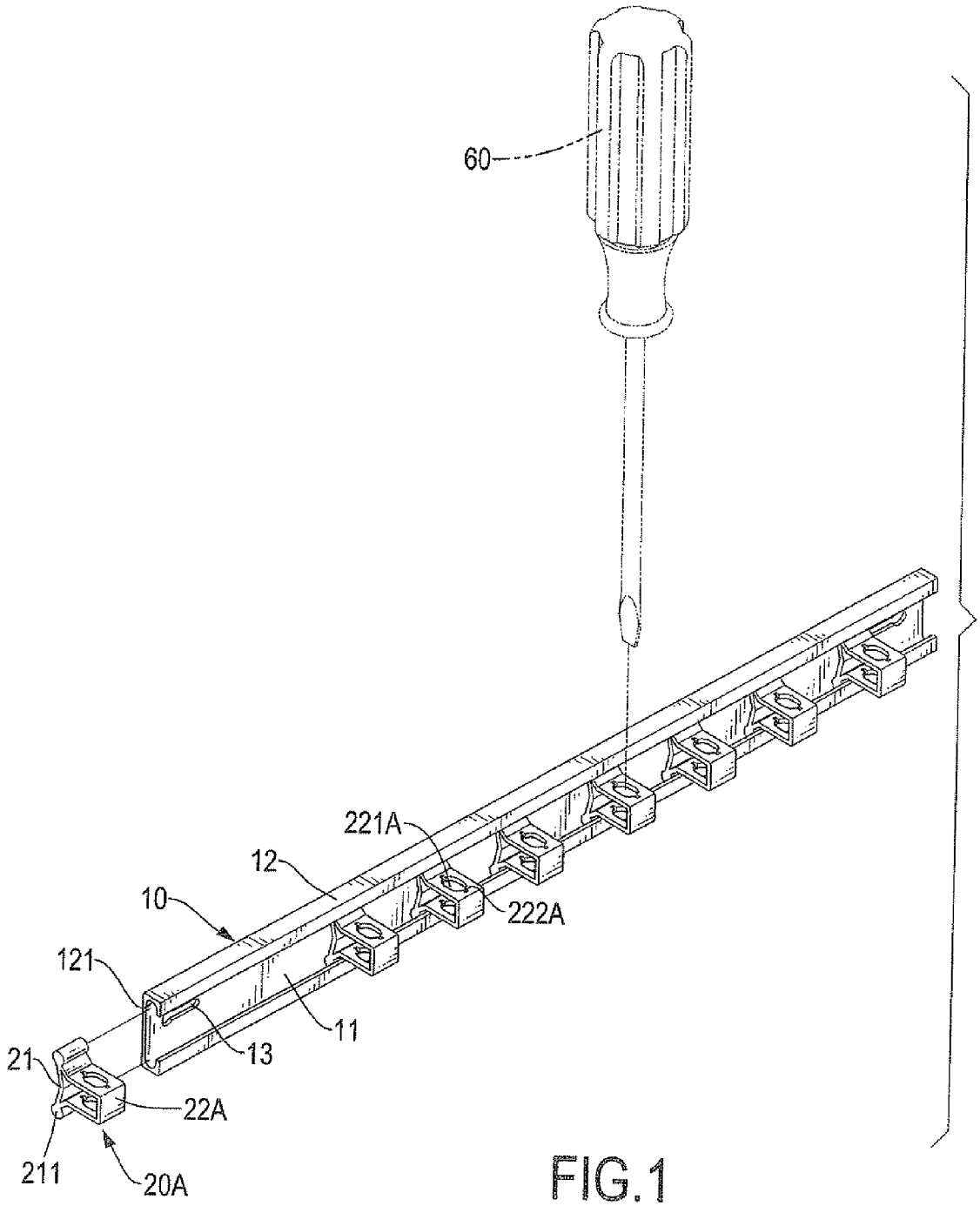
FIG. 1 is a perspective view of a first embodiment of a suspension display rack for hand tools in accordance with the present invention in usage.
Figure 2:
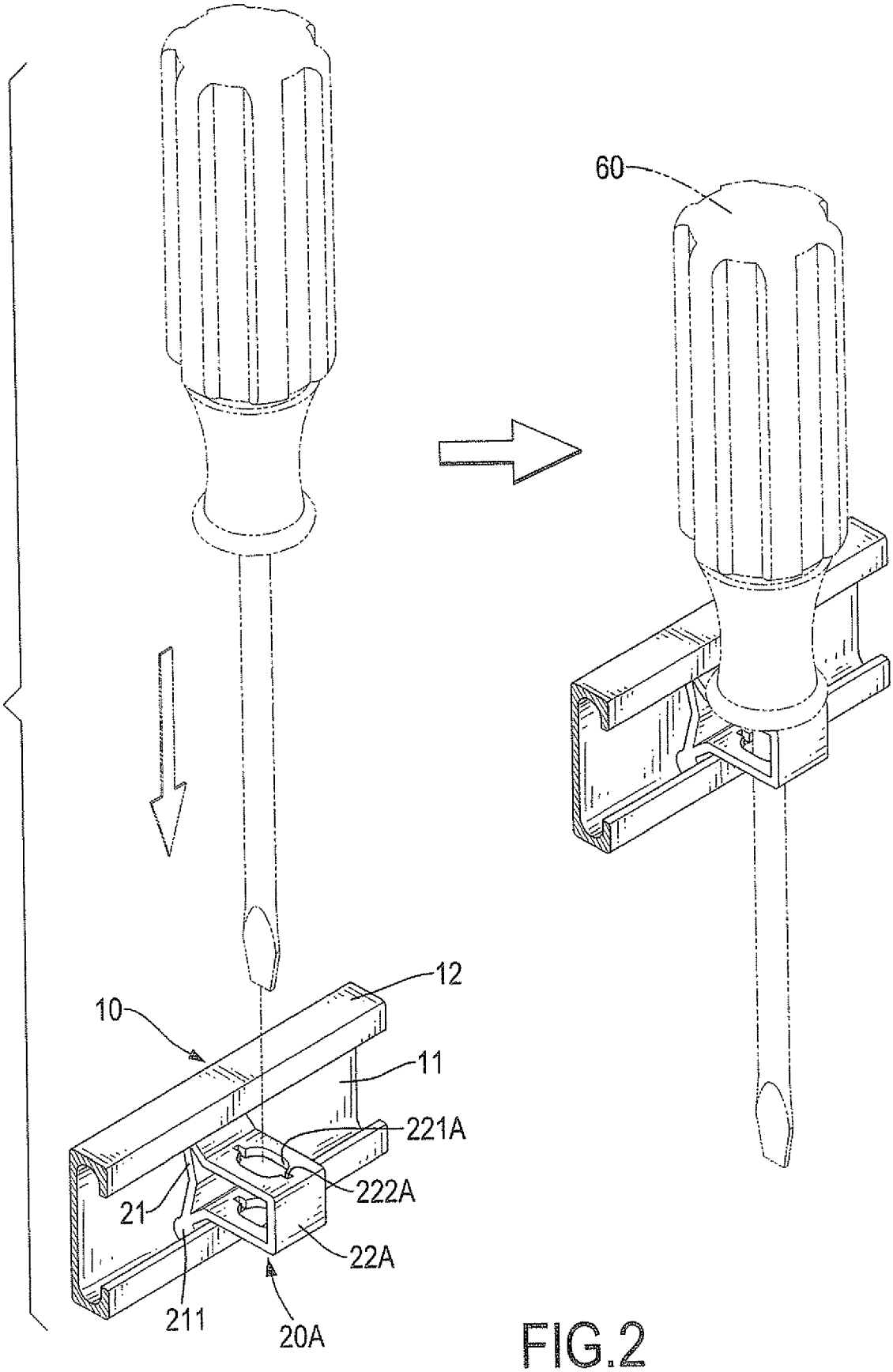
FIG. 2 is a perspective view of the first embodiment of the suspension display rack for hand tools in accordance with the present invention in usage.
Figure 3:
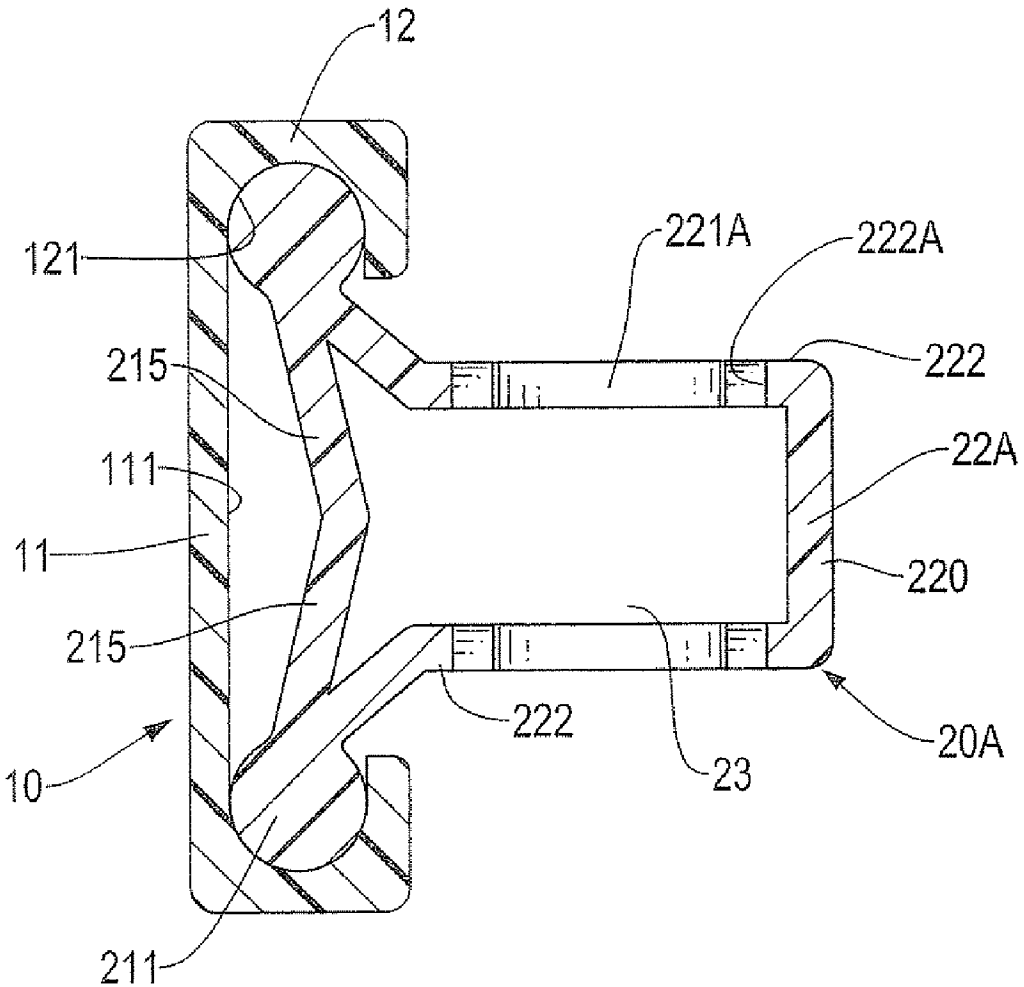
FIG. 3 is a cross sectional view of the first embodiment of the suspension display rack for hand tools in accordance with the present invention.

With reference to FIGS. 1-4, a first embodiment of a suspension display rack for hand tools in accordance with the present invention comprises a rail (10) and multiple sliding blocks (20A).

The rail (10) is longitudinal, may have a substantially C-shaped cross section and has back-strip (11) and two hooks (12) and two securing members (13).

The back strip (11) is longitudinal and flat and has an inner surface (111), a top edge, a bottom edge and two opposite ends. The inner surface (111) may be flat.

The hooks (12) are longitudinal, are formed on and perpendicularly protrude from the inner surface (111) respectively at the top and bottom edges of the back strip (11). The hooks (12) may be an upper hook and a lower hook being symmetrical to the upper hook formed in a same direction on the back-strip (11). Each hook (12) has a longitudinal groove (121). The longitudinal groove (121) is defined in the hook (12) at a joint where the hooks (12) meet the back-strip (11) and has a curved inner surface. The curved inner surface has an arcuate outline.

The securing members (13) may be holes, are respectively defined in the opposite ends of the back-strip (11) so that the rail (10) can be secured to a surface such as a wall surface via two screws being respectively extended through the securing members (13). In the first embodiment of the present invention, the securing members (13) are two oval holes and two screws can be respectively inserted into the oval holes to fasten the rail (10) to a surface such as a wall surface.

The sliding blocks (20A) are mounted slidably in the rails (10) and each sliding block (20A) has a base (21), two cylindrical slides (211) and a seat (22A) to position tools such as screwdrivers (60).

The base (21) is substantially V-shaped and has a thickness and two supporting plates (215). The supporting plates (215) are separated from the inner surface (111) of the back strip (11) at an interval and are connected to each other with an included angle being obtuse. Each supporting plate (215) has a distal end. The intervals between the supporting plates (215) and the inner surface (111) of the back strip (11) prevent friction therebetween and improve the slide of the sliding block (20A).

The cylindrical slides (211) are formed respectively on the distal ends of the supporting plates (215) of the base (21) and are slidably mounted respectively in the longitudinal grooves (121) of the hooks (12). Each cylindrical slide (211) has a diameter and a circular cross section. The diameter of the cylindrical slide (211) is larger than the thickness of each supporting plate (215) to prevent the supporting plates (215) from inadvertently contacting and rubbing against the inner surface (111) of the back strip (11). The circular cross section of the cylindrical slide (211) corresponds to the arcuate outline of the curved inner surface of the longitudinal groove (121) of one hook (12) to ensure that the cylindrical slide (211) slides smoothly in the longitudinal groove (121) without friction and obstruction.

The seat (22A) is substantially U-shaped body (20A), is formed on the distal ends of the supporting plates (215) of the base (21) and has two lateral plates (222), an upright plate (220) and a central space. The lateral plates (222) are formed on and perpendicularly protrude respectively from the distal ends of the supporting plates (215) of the base and each lateral plate (222) has a thickness, a distal end and a through hole (221A). The through hole (221A) is substantially oval-shaped, is defined through the lateral plate (222) and has an inner edge and two opposite notches (222A) defined in the inner edge. The upright plate (220) is formed perpendicularly between the distal ends of the lateral plates (222) and has a thickness. The central space (23) is surrounded and defined by the supporting plates (215), the lateral plates (222) and the upright plate (220) and has a height, a width and a depth. Each of the height, width and depth of the central space (23) is larger than the thicknesses of supporting plates (215), lateral plates (222) and upright plate (220) so that the central space (23), the hollow part without any solid material, is sufficient large to effectively reduce the material cost of the slide block (20A).

In the first embodiment of the present invention, the spaced sliding blocks (20A) are slidably mounted on the rail (10) with free distance and the quantity of the sliding blocks (20A) can be increased or decreased. Furthermore, the seat (22A) can be solid instead of defining the central space yet the through hole (221A) is singular extending from the top of the seat (22A) to the bottom of the seat (22A).

Figure 5:
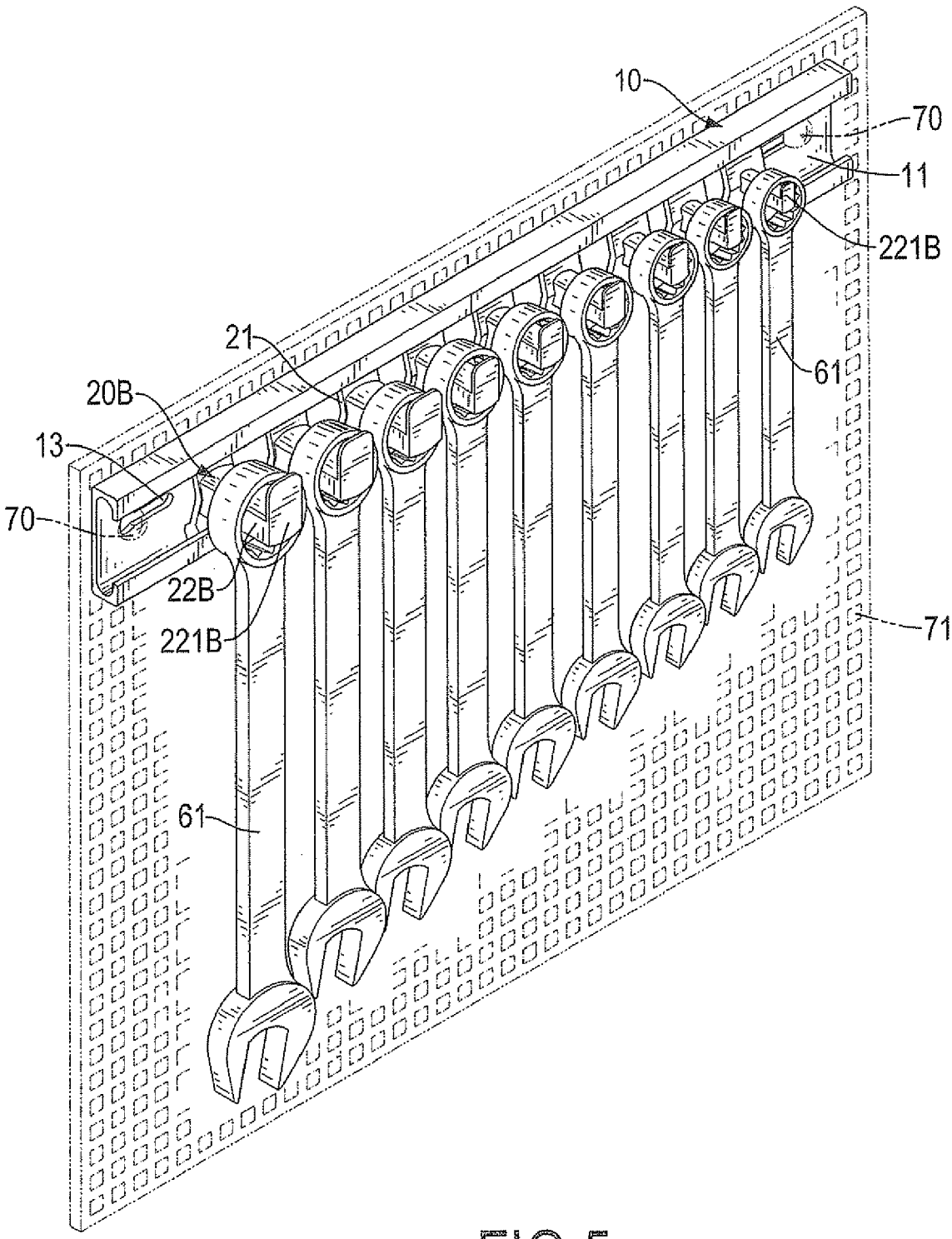
FIG. 5 is a perspective view of a second embodiment of the suspension display rack for hand tools in accordance with the present invention in usage.
Figure 6:
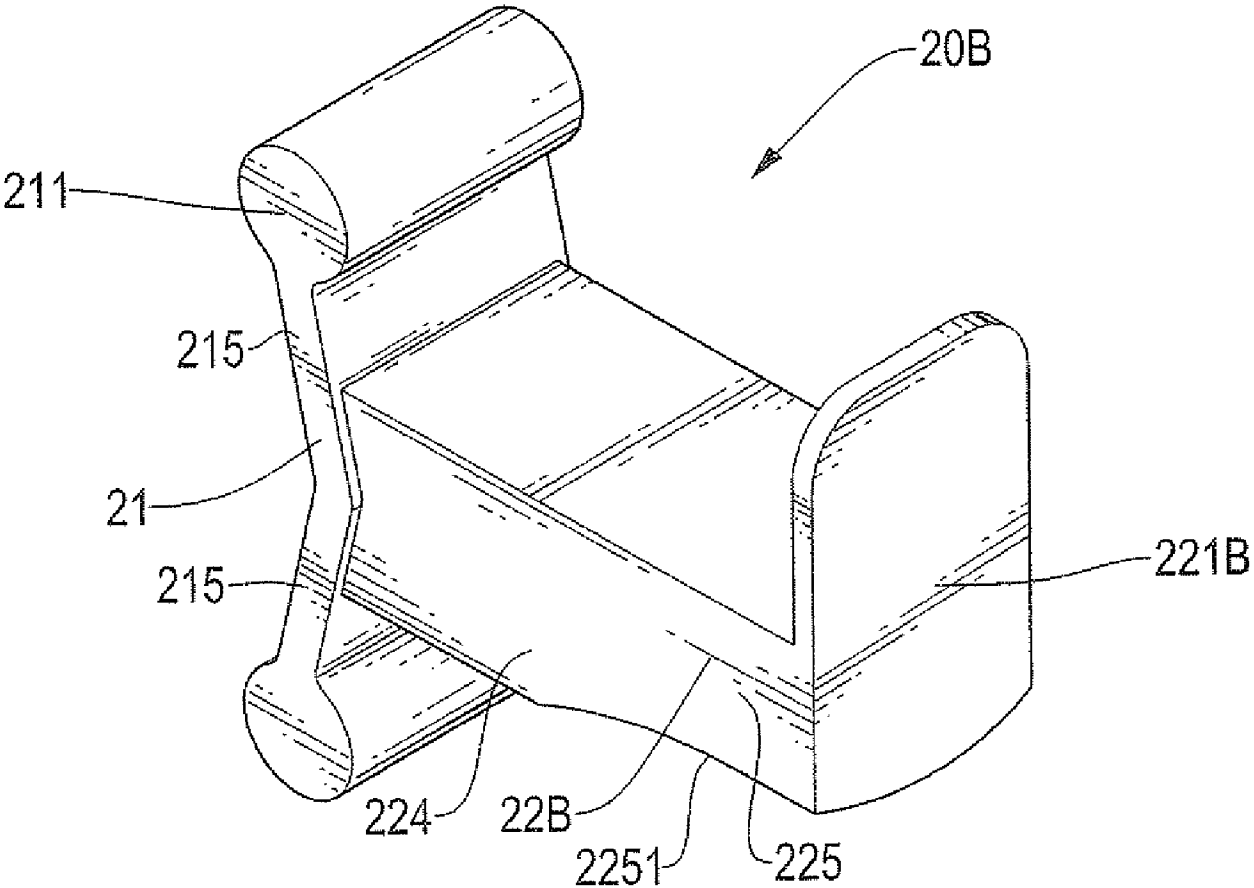
FIG. 6 is a perspective view of a seat of the second embodiment of the suspension display rack for hand tools in accordance with the present invention.
Figure 7:
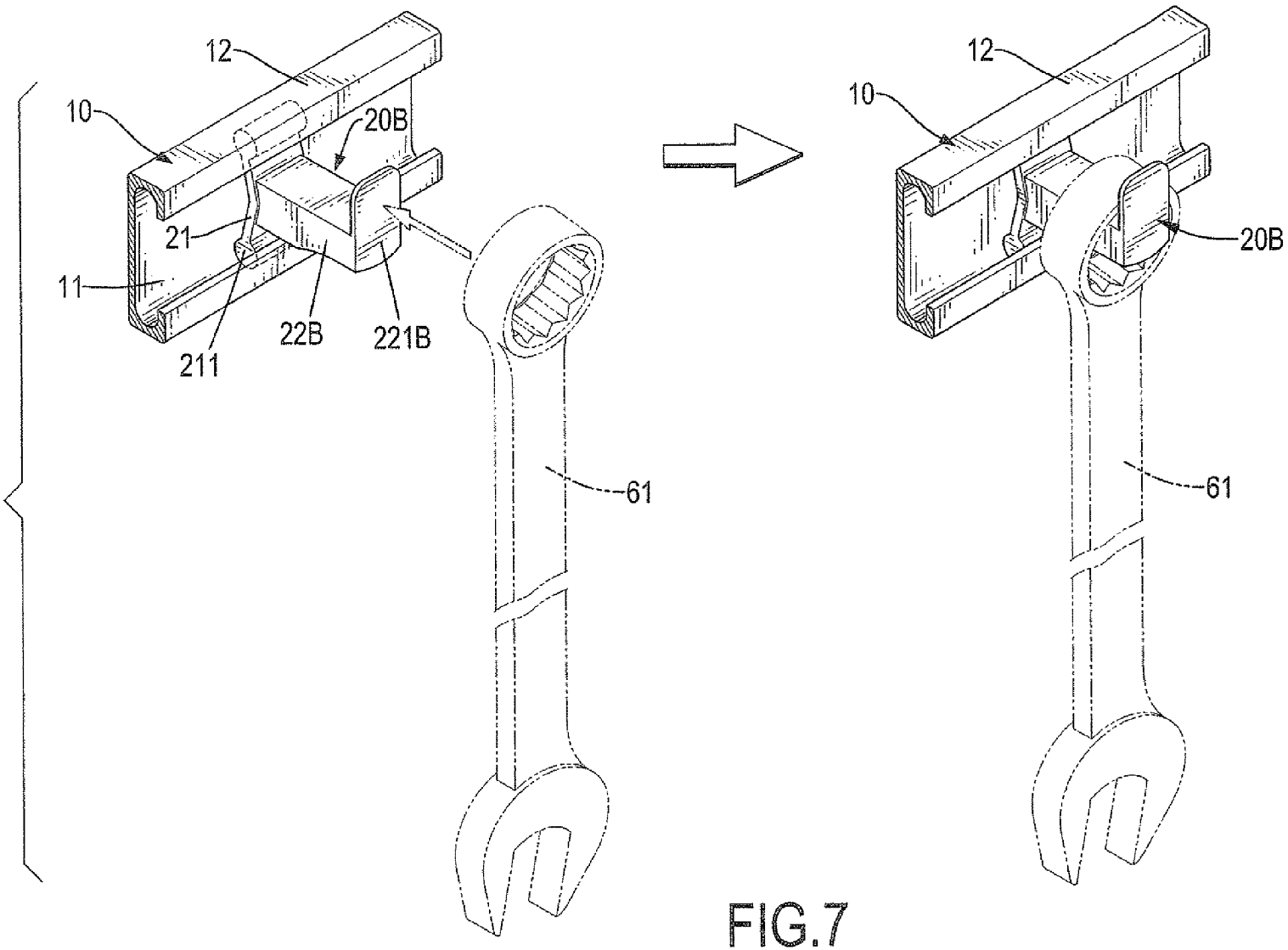
FIG. 7 is a schematic perspective view of the second embodiment of the suspension display rack for hand tools in accordance with the present invention in usage.

With reference to FIGS. 5-7, a second embodiment of the suspension rack for hand tools may be mounted on a bracket through fasteners (70) mounted respectively in mounting holes (71) of the bracket. The second embodiment is similar to the first embodiment except that a sliding block (20B) has a seat (22B) and a flange (221B). The seat (22B) is solid, is formed on and protrudes from the base (21) and has a proximal section (224) and a tapered section (225). The proximal section (224) is formed on and protrudes forwards from the base (21) and has a top surface and a bottom surface parallel to the top surface. The tapered section (225) is tapered forwards, is formed on and protrudes forwards and has a top surface and a bottom guiding surface (2251). An average thickness of the tapered section (225) is smaller than a thickness of the proximal section (224). The bottom guiding surface (21) is concave and allows a loop of a wrench (61) to be hooks smoothly on the seat (22B) without obstruction. The flange (221B) is formed on and protrudes perpendicularly and upwards from the top surface of the tapered section (225) of the seat (22B) thereby hooking the wrench (61) mounted on the seat (22B).

Figure 8:
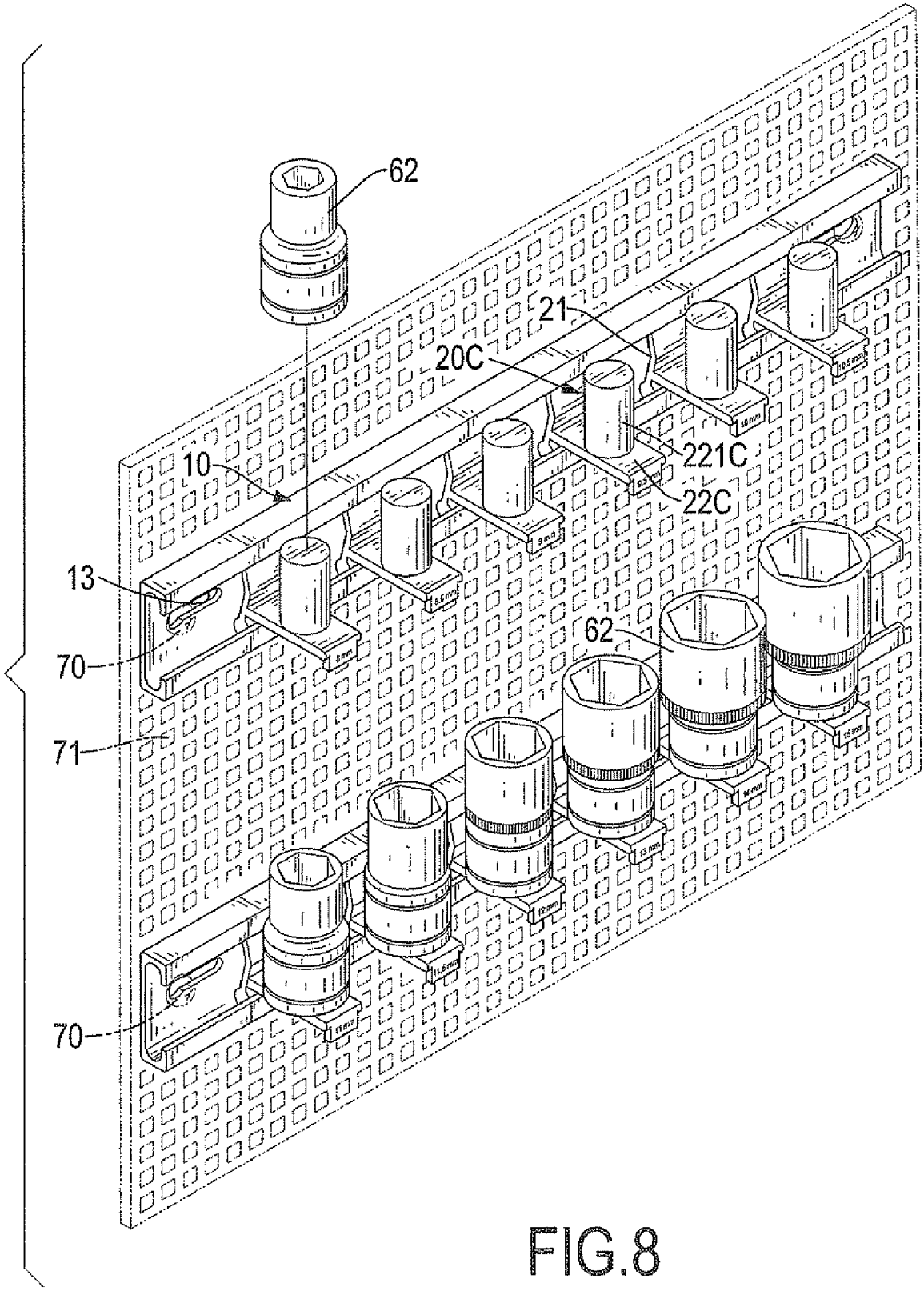
FIG. 8 is a schematic perspective view of a third embodiment of the suspension display rack for hand tools in accordance with the present invention in usage.
Figure 9:
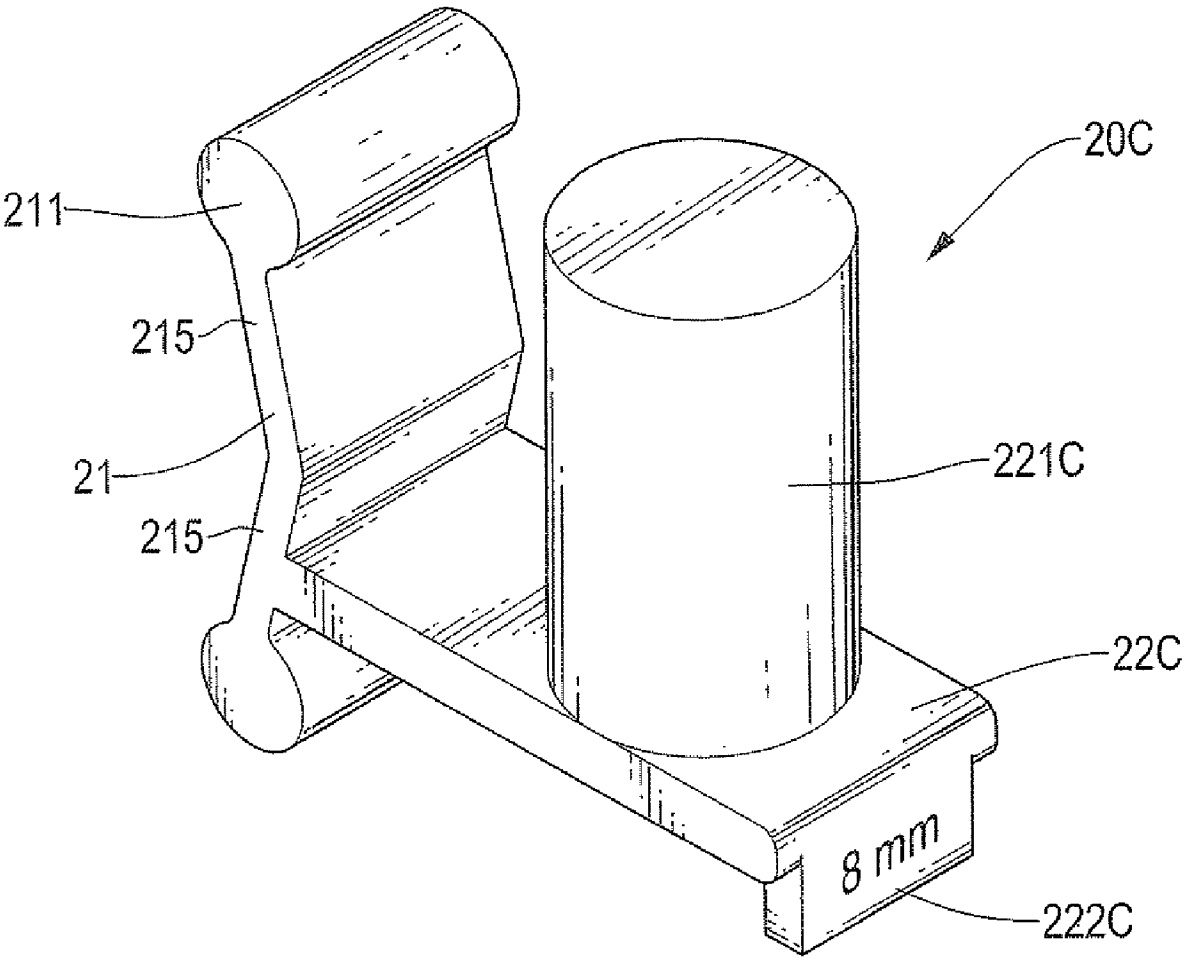
FIG. 9 is a perspective view of a seat of the third embodiment of the suspension display rack for hand tools in accordance with the present invention.
Figure 10:
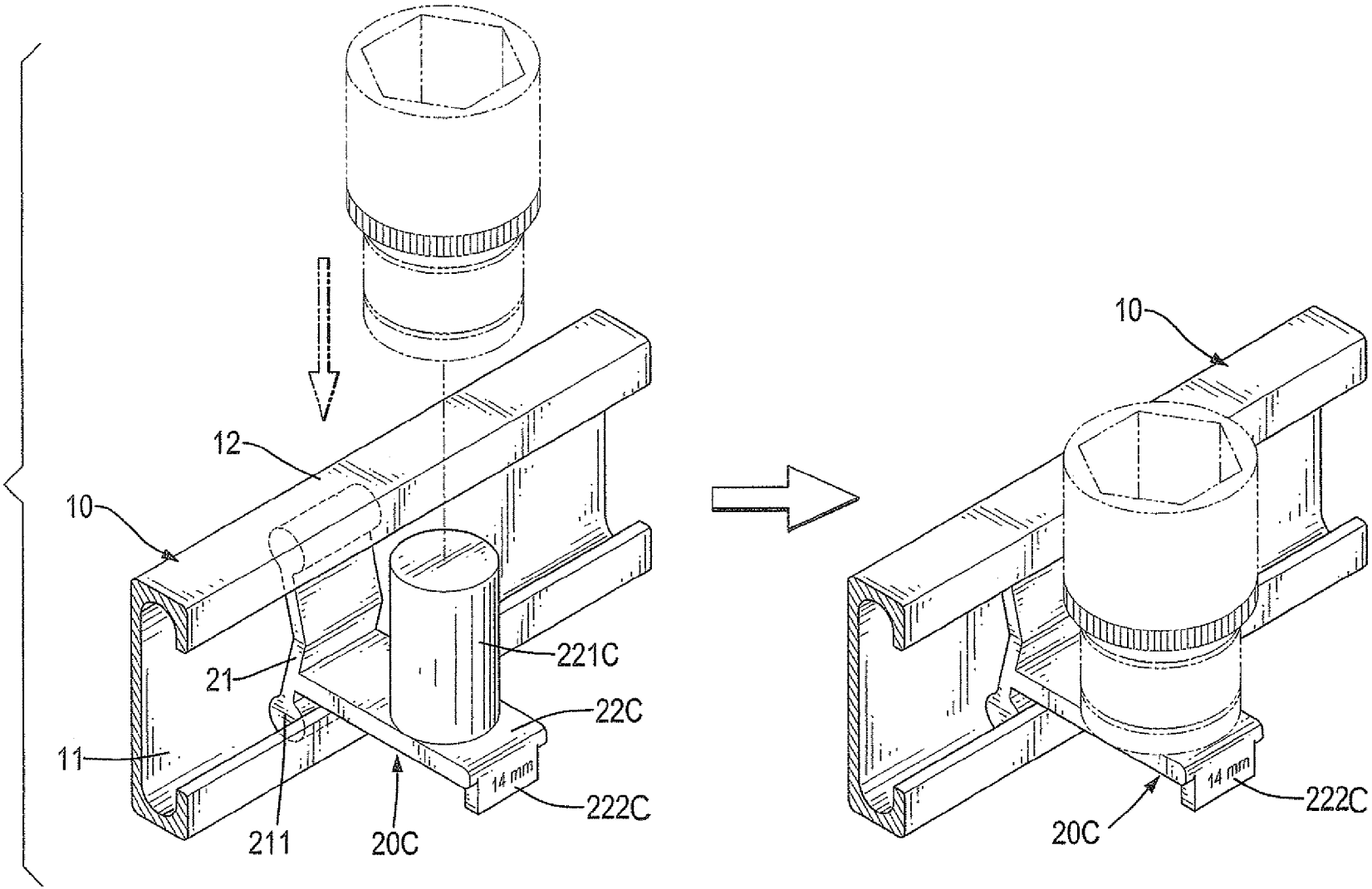
FIG. 10 is a schematic perspective view of the seat of the third embodiment of the suspension display rack for hand tools in accordance with the present invention.

With reference to FIGS. 8-10, a third embodiment of the suspension rack is similar to the first embodiment except that a sliding block (20C) has a base (21), two cylindrical slides (211), a seat (22C), a barrel (221C) and a finger (222C). The seat (22C) is a plate, is formed on and protrudes forwards from the base (21) and has a proximal end, a distal end and a top surface. The barrel (221C) is formed on and protrudes upwards from a center of the seat (22C), is at a distance from the proximal end and at a distance from the distal end of the seat (22C). The distance between the distal end of the seat (22C) and the barrel (221C) allows the top surface of the seat (22C) to securely hold a tool socket mounted around the barrel (221C). The finger (222C) is formed on and protrudes downwards from the distal end of the seat (22C) and has an identification label such as "8 mm" formed on the finger (222C) to identify a tool rested on the seat (22C).

Figure 11:
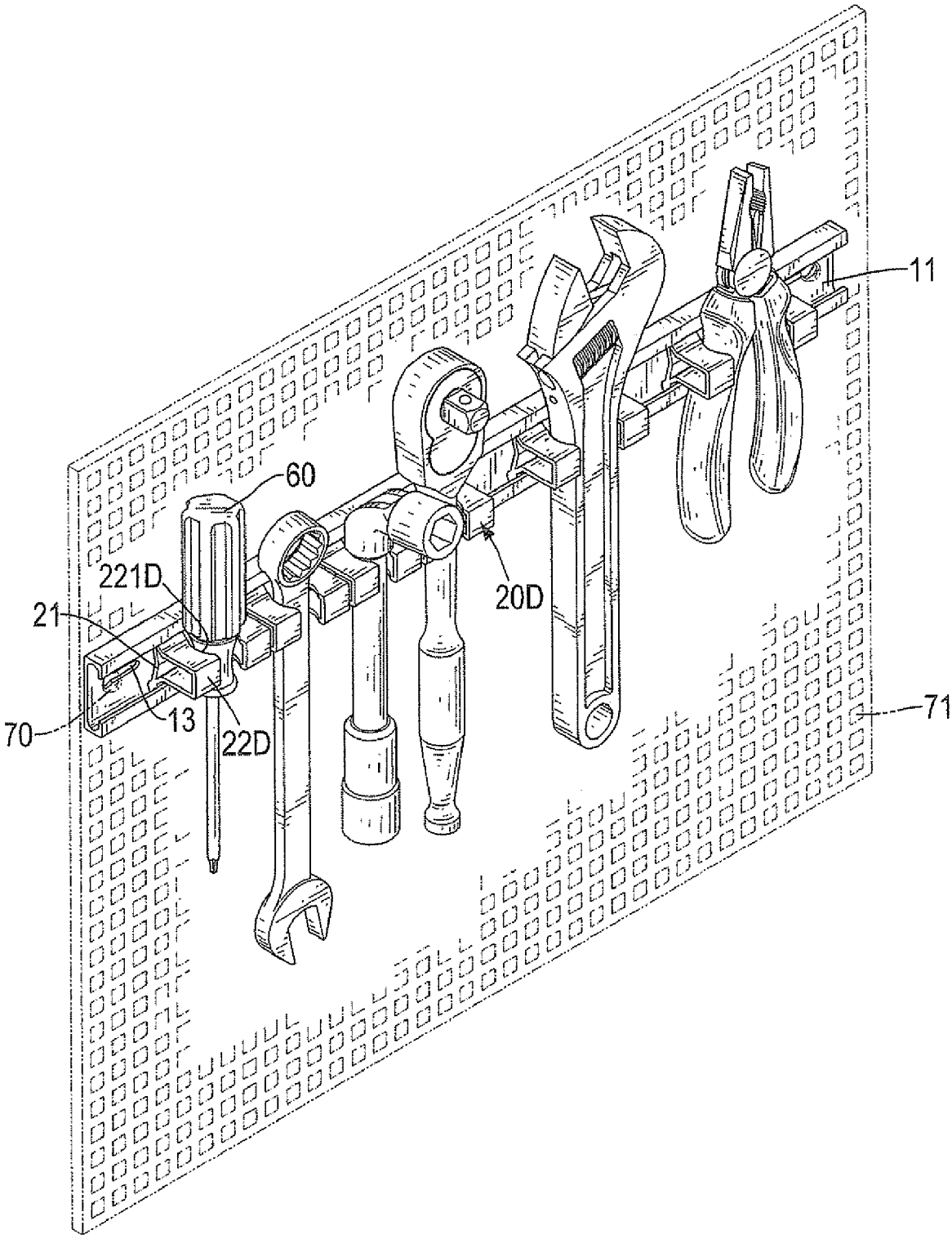
FIG. 11 is a perspective view of a fourth embodiment of the suspension display rack for hand tools in accordance with the present invention in usage.
Figure 12:
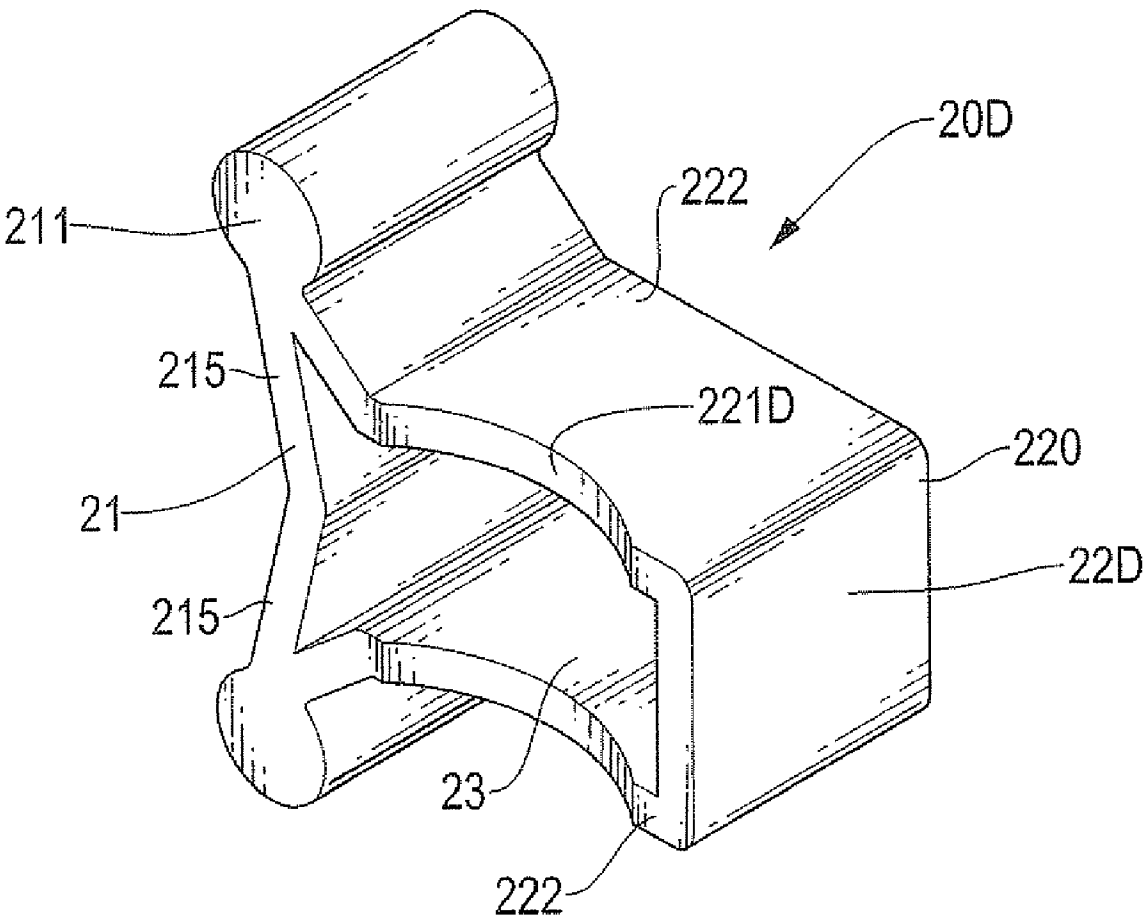
FIG. 12 is a perspective view of a seat of the fourth embodiment of the suspension display rack for hand tools in accordance with the present invention.
Figure 13:
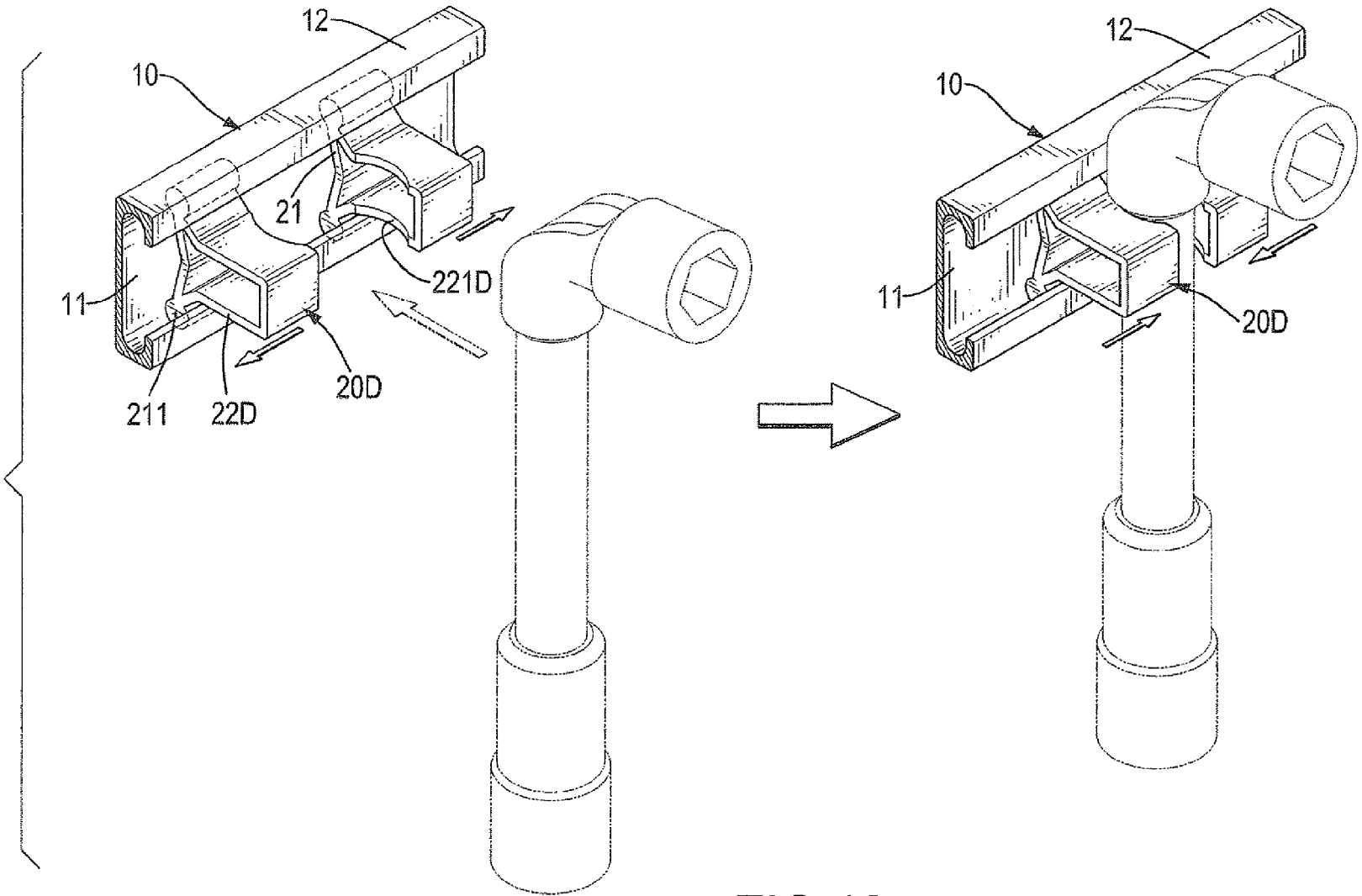
FIG. 13 is a schematic perspective view of the fourth embodiment of the suspension display rack for hand tools in accordance with the present invention.

With reference to FIGS. 11-13, a fourth embodiment of the suspension rack is similar to the first embodiment except that a sliding block (20D) has a semi seat (22D) and each of two adjacent sliding blocks (20D) cooperate with each other to form a clamp to clamp a tool. The semi seat (22D) is similar to the seat (22A) in the first embodiment and has two parallel arcuate cutouts (221D) defined respectively in the lateral plates (222) of the semi seat (22D). The arcuate cutouts (221D) on the semi seat (22D) of one of the adjacent sliding blocks (20D) respectively face the cutouts (221D) on the semi seat (22D) of the other sliding block (20D) so that the hand tool can be gripped in the cutouts (221D).

With reference to FIG. 1, after a tip of the screwdriver (60) is inserted into the through holes (221A) and the notches (222A), the screwdriver (60) is rotated a certain amount in an axial direction so that each tip does not correspond to each notch (222A) to prevent the screwdriver from being easily pulled out of the through hole (221A), thus deterring shoplifters. Furthermore, the sliding blocks (20A) can slide along the rail (10) freely and therefore, the distance between each screwdriver (60) is not immovable.

With reference to FIGS. 5-7, 8-10, and 11-13, the second, the third and the fourth embodiments of the suspension rack for hand tools are respectively similar to the first embodiment, except that the second embodiment is used for hanging wrenches (61), the third embodiment is used for hanging sockets (62) and the fourth embodiment is used for hanging the hand tools with one end larger than the other and the larger end being higher.

Figure 4:
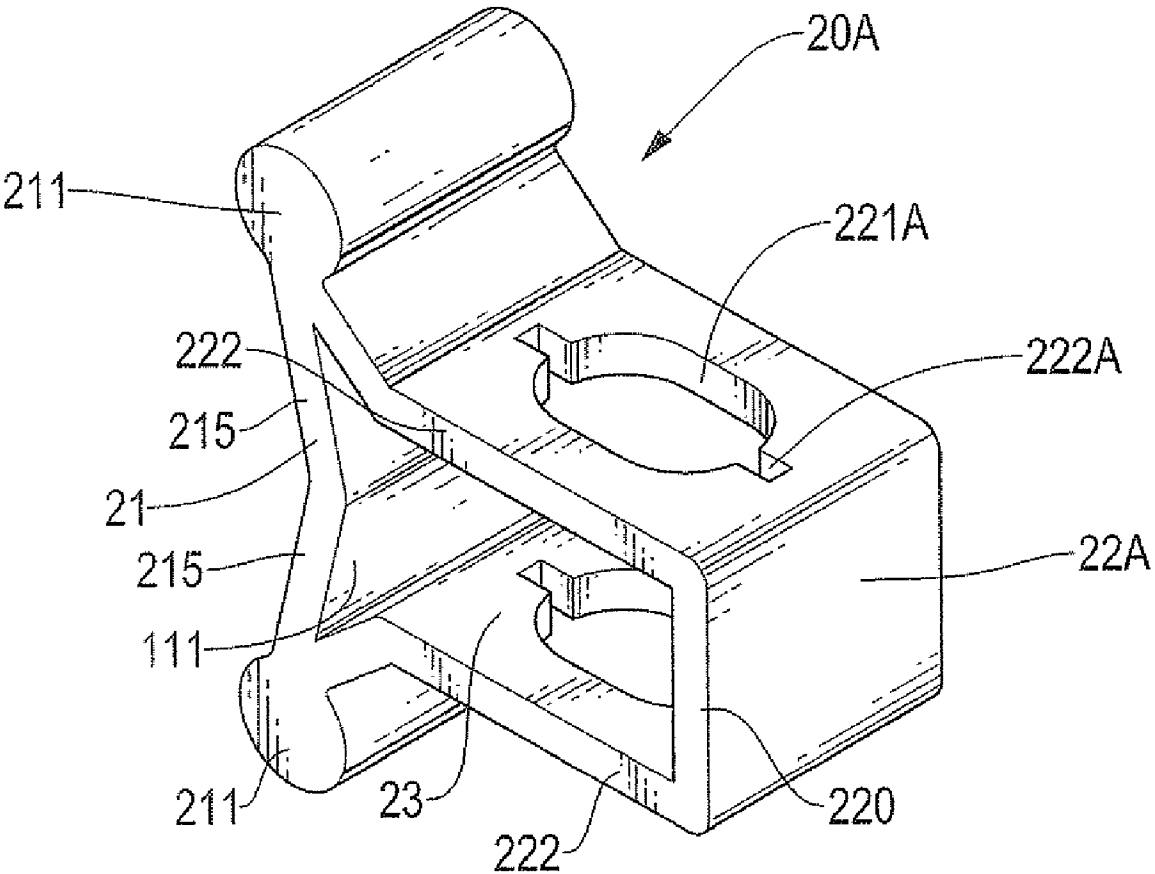
FIG. 4 is a perspective view of a seat of the first embodiment of the suspension display rack for hand tools in accordance with the present invention.
Figure 14:
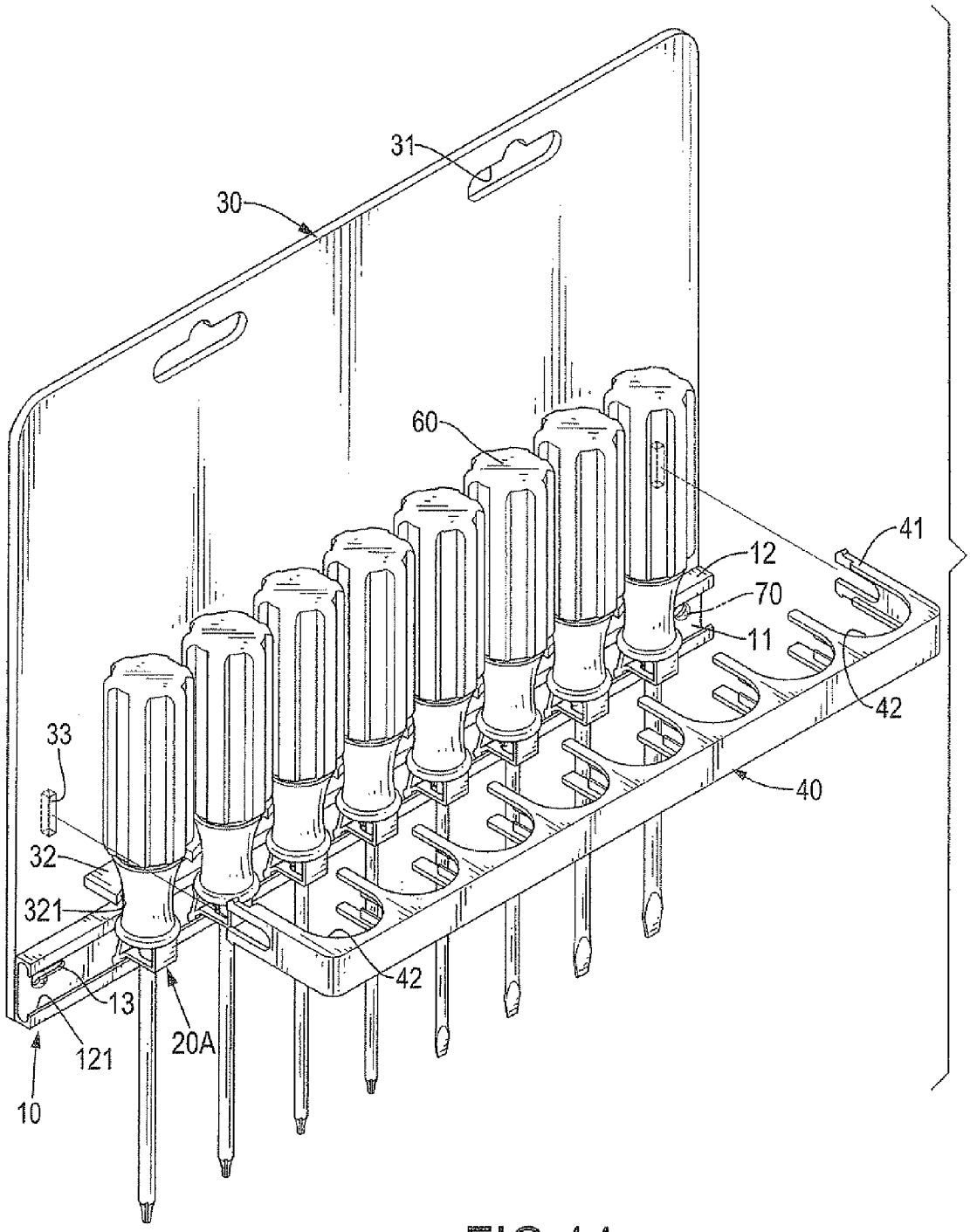
FIG. 14 is a perspective view of the suspension display rack for hand tools in FIG. 1 further having an anti-theft feature.

With reference to FIGS. 1, 4 and 14, the first embodiment may be mounted on a sheet (30) to form a suspension wall rack for hand tools for protection against theft. Specifically, the first embodiment may further comprise a sheet (30), multiple lateral fins (32), and a bridge-like clamp (40).

The length of the sheet (30) is the same as the length of the rail (10) and two openings (31) are defined in a top end of the sheet (30) so that the sheet (30) can be hung on a proper location. At least one fastener (70) is inserted into each oval hole and then into a bottom end of the sheet (30) and therefore, the rail (10) is securely mounted on the sheet (30). The fins (32) are perpendicular to the sheet (30) and are above the rail (10), and an arcuate cut-out (321) is defined in each fin (32) and opposed to the sheet (30). The quantity of the fins (32) is the same as that of the sliding blocks (20A) and two upright slots (33) are respectively defined in two opposed ends of the sheet (30) and above the fins (32).

Multiple even-spaced U-like recesses (42) are respectively defined in the bridge-like board (40), and two fork-like members (41) are respectively formed in two opposed ends of the bridge-like board (40) and detachably mated with the slots (33) so that the bridge-like board (40) can be securely mounted on the sheet (30) and the U-like recesses (42) are mounted above the fins (32).

When the suspension rack for hand tools is used for hanging the screwdrivers (60), the screwdrivers (60) are respectively downwardly inserted into the notches (222A) and the through holes (221A). Furthermore, each U-like recess (42) has a periphery that is pressed against the handle and a middle portion of each screwdriver (60). The outer circumference of each U-like recess is smaller than that of the handle, and inclined against the arcuate cut out (321) so that the screwdriver (60) can not be upwardly pulled out of the through hole (221A) thus achieving a theft-proof effect.

When the bridge-like board (40) is separated from the slots (33) and the tip of each screwdriver (60) aligns with the through hole (221A), the screwdrivers (60) can be taken out of the through hole (221A). Furthermore, when the fasteners (70) are respectively taken out of the oval holes, the rail (10) can be hung on the proper location for use due to the oval holes being mated with the fasteners, and screwdrivers (60) can be slidably mounted along the rail (10) due to the sliding blocks (20A) for flexible usage.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A suspension display rack for tools comprising:

a rail having a back-strip being longitudinal and flat and having an inner surface, a top edge, a bottom edge and two opposite ends;

two hooks being longitudinal, being formed on and perpendicularly protruding from the inner surface respectively at the top and bottom edges of the back strip and each hook having a longitudinal groove defined in the hook and having a curved inner surface, and the curved inner surface having an arcuate outline; and two securing members defined respectively at opposite ends of the back-strip;

multiple sliding blocks mounted slidably in the rail and each sliding block having a base being substantially V-shaped and having a thickness; and two supporting plates separated from the inner surface of the back strip at an interval, connected to each other with an included angle being obtuse and each supporting plate having a distal end;

two cylindrical slides formed respectively on the distal ends of the supporting plates of the base, slidably mounted respectively in the longitudinal grooves of the hooks and each cylindrical slide having a diameter being larger than the thickness of each supporting plate; and a circular cross section corresponding to the arcuate outline of the curved inner surface of the longitudinal groove of one hook; and a seat being substantially U-shaped body, formed on the distal ends of the supporting plates of the base and having two lateral plates formed on and perpendicularly protruding respectively from the distal ends of the supporting plates of the base and each lateral plate having a thickness and a distal end;

an upright plate formed perpendicularly between the distal ends of the lateral plates and having a thickness; and a central space surrounded and defined by the supporting plates, the lateral plates and the upright plate and having a height, a width and a depth and each of the height, width and depth of the central space being larger than the thicknesses of supporting plates, lateral plates and upright plate, wherein the seat of each sliding block is a semi seat and each of two adjacent sliding blocks cooperates with each other to form a clamp;

the semi seat of each sliding block has two arcuate cutouts defined respectively in the lateral plates of the semi seat and being parallel to each other; and the arcuate cutouts on the semi seat of one of the adjacent sliding blocks respectively face the cutouts on the semi seat of the other sliding block.

* * * * *